US011351415B1

(12) United States Patent
Alao

(10) Patent No.: US 11,351,415 B1
(45) Date of Patent: Jun. 7, 2022

(54) PORTABLE MULTI-EXERCISE DEVICE

(71) Applicant: Samuel Alao, Kansas City, KS (US)

(72) Inventor: Samuel Alao, Kansas City, KS (US)

( * ) Notice: Subject to any disclaimer, the term of this patent is extended or adjusted under 35 U.S.C. 154(b) by 0 days.

(21) Appl. No.: 17/569,131

(22) Filed: Jan. 5, 2022

(51) Int. Cl.
*A63B 23/035* (2006.01)
*A63B 23/04* (2006.01)
(Continued)

(52) U.S. Cl.
CPC .... *A63B 23/03575* (2013.01); *A63B 21/0442* (2013.01); *A63B 21/0552* (2013.01);
(Continued)

(58) Field of Classification Search
CPC ..... A63B 21/00058; A63B 21/00061; A63B 21/00065; A63B 21/00069; A63B 21/00076; A63B 21/00178; A63B 21/00185; A63B 21/002; A63B 21/0023; A63B 21/02; A63B 21/04; A63B 21/0407; A63B 21/0414; A63B 21/0421; A63B 21/0428; A63B 21/0435; A63B 21/0442; A63B 21/055; A63B 21/0552; A63B 21/0555; A63B 21/0557; A63B 21/068; A63B 21/16; A63B 21/4023; A63B 21/4027; A63B 21/4033; A63B 21/4034; A63B 21/4035; A63B 21/4045; A63B 22/0046; A63B 22/20; A63B 22/201; A63B 22/203; A63B 23/035; A63B 23/03516; A63B 23/03533; A63B 23/03541; A63B 23/0355; A63B 23/03558; A63B 23/03575; A63B 23/04; A63B 23/0482; A63B 23/0488; A63B 23/12; A63B 23/1209; A63B 23/1245; A63B 23/1281; A63B 69/0022; A63B 69/18; A63B 69/182; A63B 2208/0204; A63B 2210/00; A63B 2210/50; A63B 2225/09; A63B 2244/18; A63B 2244/186
See application file for complete search history.

(56) References Cited

U.S. PATENT DOCUMENTS 3,547,434 A * 12/1970 Ossenkop ..... A63B 69/18 482/71
3,589,720 A * 6/1971 Agamian ..... A63B 22/203 482/114
(Continued)

*Primary Examiner* — Gary D Urbiel Goldner
(74) *Attorney, Agent, or Firm* — Dale J. Ream

(57) ABSTRACT

A portable multi-exercise device includes a pair of parallel tracks each being elongate and linear. The exercise device includes a pair of band attachment platforms positioned across the parallel tracks respectively proximate to ends of the parallel tracks, the band attachment platforms having at least two laterally spaced apart resistance band attachment structures and themselves being laterally positioned along the parallel tracks. Each band attachment platform may include a set of three spaced apart planks defining a slot therebetween in which band fasteners are positioned. The exercise device includes a pair of step platforms atop which a user stands when grasping resistance bands during exercise, the step platforms being laterally adjustable along the parallel tracks. The exercise device includes a rowing bar coupled to the pair of parallel tracks intermediate the band attachment platforms and having fasteners for attachment to the resistance bands.

9 Claims, 6 Drawing Sheets

(51) Int. Cl.
*A63B 21/00* (2006.01)
*A63B 21/055* (2006.01)
*A63B 21/04* (2006.01)
*A63B 23/12* (2006.01)

(52) U.S. Cl.
CPC ..... *A63B 21/4034* (2015.10); *A63B 21/4045* (2015.10); *A63B 23/03541* (2013.01); *A63B 23/0488* (2013.01); *A63B 23/1281* (2013.01); *A63B 2208/0204* (2013.01)

(56) References Cited

U.S. PATENT DOCUMENTS 5,147,266 A * 9/1992 Ricard ..... A61H 1/0244 482/133
5,295,935 A * 3/1994 Wang ..... A63B 21/4033 482/130
5,328,427 A * 7/1994 Sleamaker ..... A63B 69/0022 482/110
5,520,598 A * 5/1996 Little ..... A63B 21/0615 482/79
6,280,366 B1 8/2001 Hsieh
6,368,254 B1 * 4/2002 Wall ..... A63B 21/055 482/122
7,798,943 B1 * 9/2010 Tsai ..... A63B 22/0005 482/121
8,641,582 B2 * 2/2014 Ahmadi Mirghaed ..... A61H 1/0244 482/79
8,961,373 B2 * 2/2015 Halver ..... A63B 21/4047 482/52
9,011,296 B2 * 4/2015 Peralo ..... A63B 23/03575 482/123
9,868,011 B2 * 1/2018 Lagree ..... A63B 21/055
10,456,620 B1 * 10/2019 Duenas ..... A63B 21/0552
10,806,985 B1 * 10/2020 Loane ..... A63B 22/201
10,940,354 B2 3/2021 Oltorik, Jr.
2002/0151417 A1 * 10/2002 List ..... A63B 21/169 482/146
2003/0216230 A1 11/2003 Wang
2007/0087920 A1 4/2007 Dachraoui et al.
2012/0035028 A1 * 2/2012 Ahmadi Mirghaed ..... A61H 1/0244 482/129
2012/0115692 A1 5/2012 Bussen et al.
2013/0217551 A1 * 8/2013 Parnell ..... A63B 21/00178 482/141
2014/0011645 A1 * 1/2014 Johnson ..... A63B 23/03525 482/121
2014/0011647 A1 * 1/2014 Lalaoua ..... A63B 21/00061 482/125
2014/0031175 A1 * 1/2014 Peralo ..... A63B 21/4045 482/66
2014/0336025 A1 11/2014 Rafferty
2015/0119204 A1 * 4/2015 Loane ..... A63B 21/4045 482/71
2015/0231471 A1 * 8/2015 Craig ..... A63B 69/0062 473/452
2019/0269955 A1 * 9/2019 Budylina ..... A63B 21/4035

* cited by examiner

PORTABLE MULTI-EXERCISE DEVICE

BACKGROUND OF THE INVENTION

This invention relates generally to exercise devices and, more particularly, to a multi-exercise device that may be assembled/disassembled quickly so as to be portable and enables a user to perform multiple exercises without the need for weights or barbells.

The most commonly known location for a person to exercise or workout is at a gymnasium, members-only exercise facility, school, or the like. Alternatively, consumers may purchase weightlifting benches, free weights, barbells, and many other exercise accessories for use at home. More recently, complex devices using resistance bands have become popular for home use. In addition, both free weights and resistance bands may be available at hotels for persons traveling for business or pleasure.

Although presumably effective for their intended purposes, there is still a need for an effective exercise device for use with resistance bands that may be easily assembled or disassembled and is truly portable between a consumer's home and remote lodging, whether that be at a hotel, AIRBNB, or the like. (AIRBNB is a service that lets property owners rent out their spaces to travelers looking for a place to stay).

Therefore, it would be desirable to have a portable multi-exercise device that includes laterally adjustable resistance band attachment platforms, laterally adjustable step platforms, a rowing bar, and a pair of resistance bands that may be coupled to each of the aforementioned elements. Further, it would be desirable to have a portable multi-exercise device that may be assembled and disassembled quickly and carried in a bag for transport between a home and hotel installation.

SUMMARY OF THE INVENTION

A portable multi-exercise device according to the present invention includes a frame having a pair of tracks that are parallel to one another and each track having an elongate and linear configuration and each track having a first end and a second end opposite said first end. A pair of band attachment platforms are coupled to said pair of tracks, respectively, each band attachment platform being displaced a first distance inwardly from said first and second ends of said pair of tracks, respectively. For the sake of lateral adjustment, each band attachment platform has a first outer attachment structure and a second attachment structure inwardly spaced apart from said first attachment structure. In an embodiment, each band attachment platform includes a set of three planks, each plank extending between and being releasably coupled to said pair of tracks, respectively. Each plank is laterally spaced apart from a next adjacent plank with adjacent planks defining a slot therebetween. First and second attachment structures are axially coupled to said adjacent planks and positioned in said slots, respectively.

In a critical aspect, the portable multi-exercise device includes a pair of resistance bands each having a band fastener releasably and selectively coupled to said first or second attachment structures, respectively, and forming a loop handle opposite said band fastener. Further, the portable multi-exercise device includes a pair of step platforms coupled to said pair of tracks, respectively, each step platform being mounted intermediate said pair of band attachment platforms and being configured for supporting a foot of a user. Each step platform is laterally positioned along the pair of tracks.

Therefore, a general object of this invention is to provide a portable multi-exercise device that enables a user to assemble and disassemble for use in exercising when away from the home or gym.

Another object of this invention is to provide a portable multi-exercise device, as aforesaid, that includes exercise bands that may be laterally positioned so as to exercise multiple muscle groups.

Still another object of this invention is to provide a portable multi-exercise device, as aforesaid, having foot platforms that are laterally adjustable to enable multiple exercises to be performed.

Yet another object of this invention is to provide a portable multi-exercise device, as aforesaid, that enables strength training of one's arms and legs without hard weight or barbells.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1:
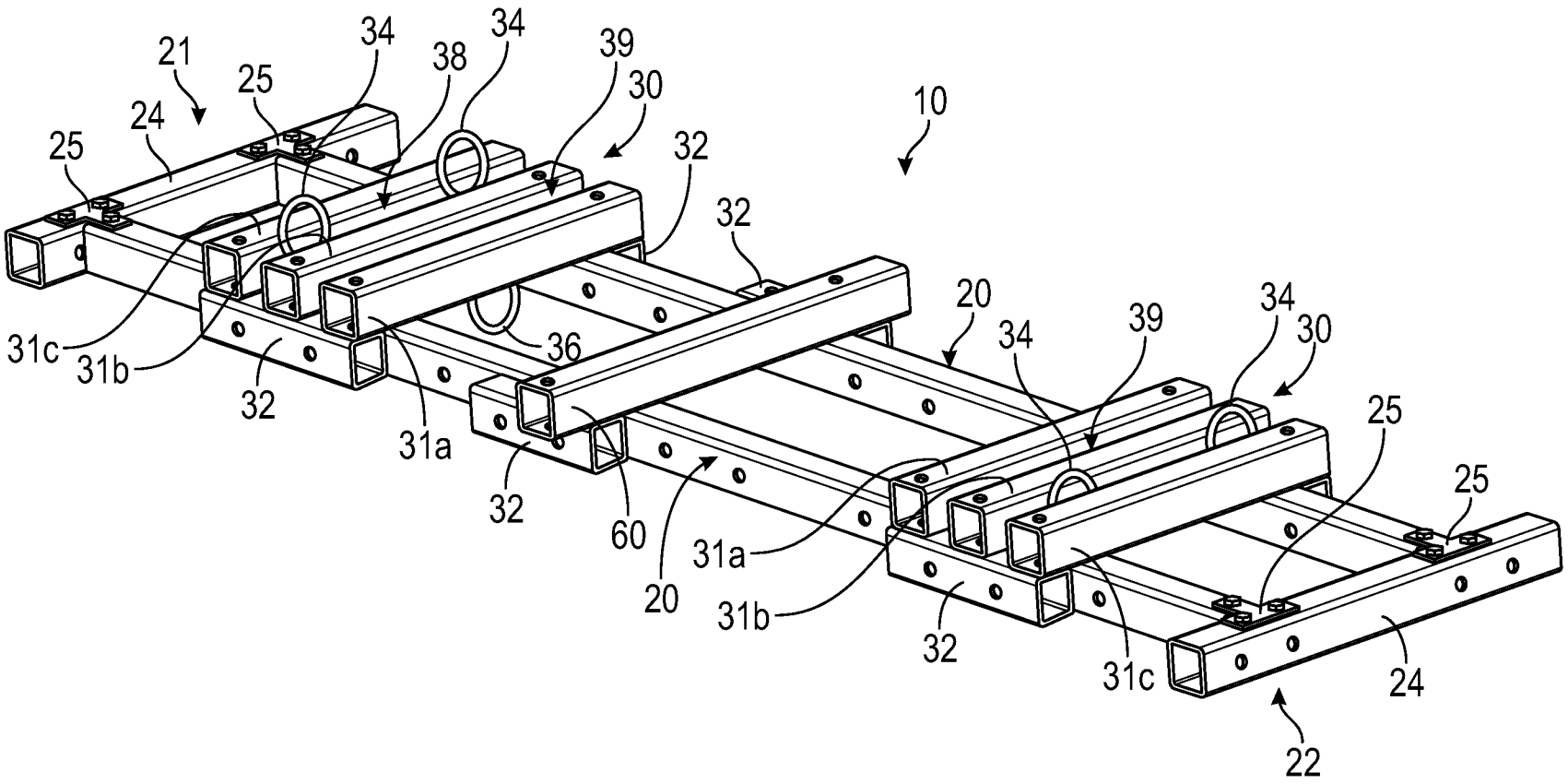
FIG. 1 is a perspective view of a portable multi-exercise device according to a preferred embodiment of the present invention.
Figure 2:
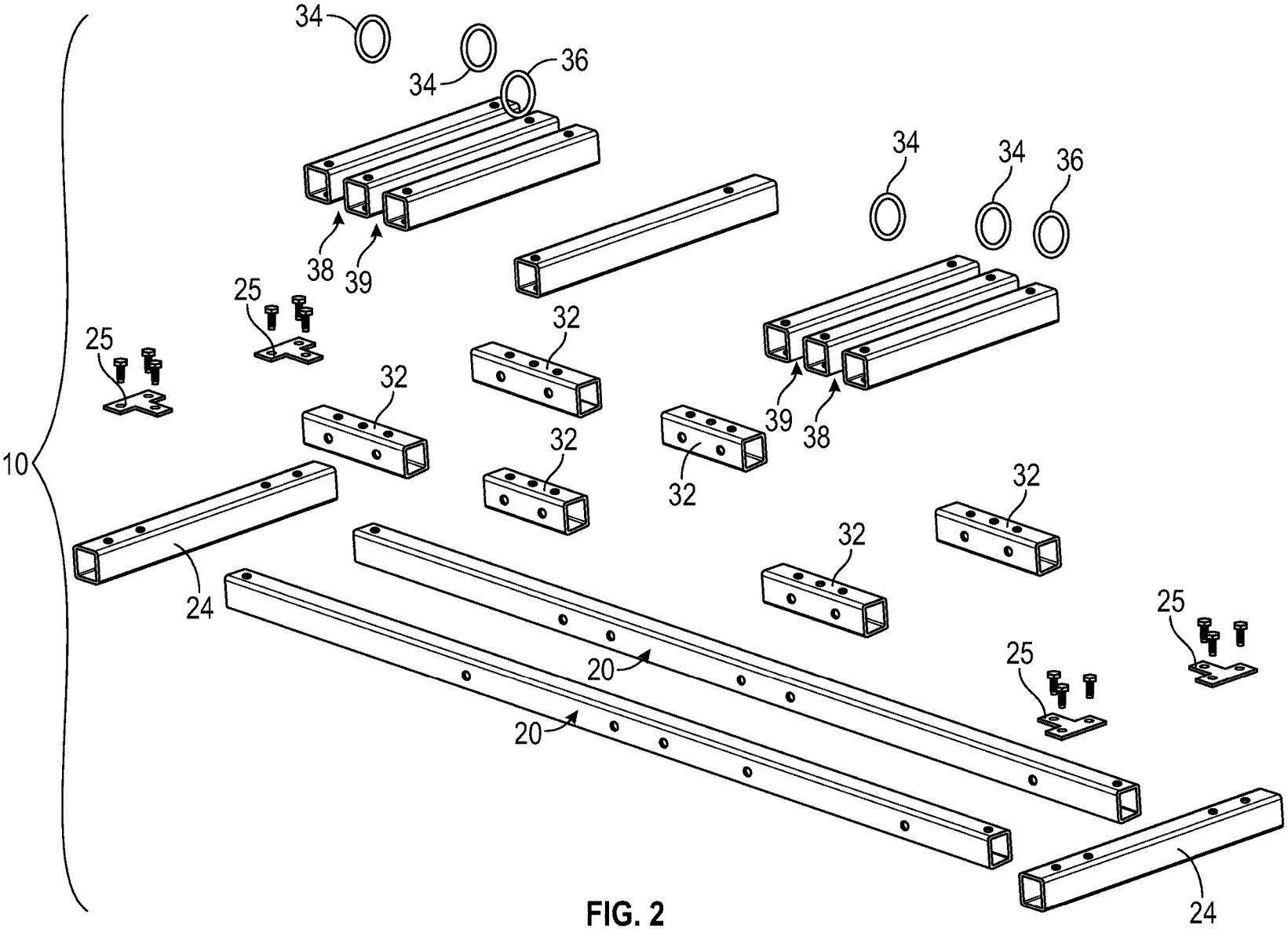
FIG. 2 is an exploded view of the portable multi-exercise device as in FIG. 1.
Figure 3:
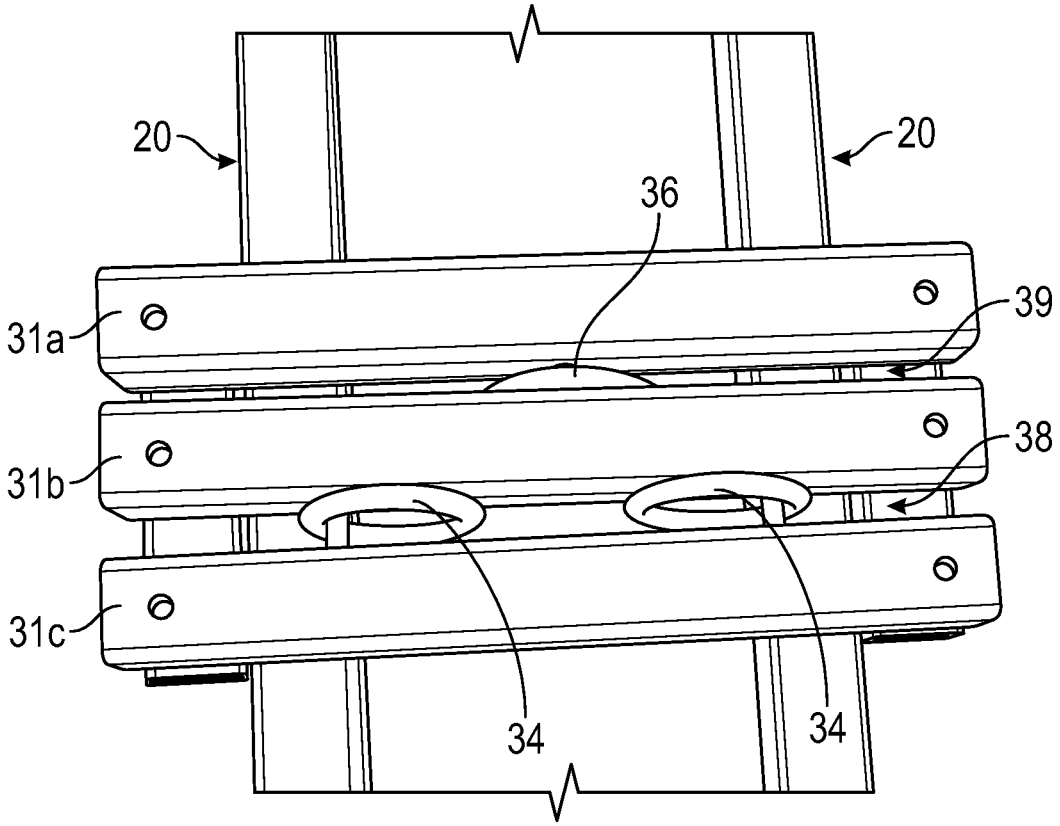
FIG. 3 is an isolated top view of a band attachment platform taken from FIG. 1.

A portable multi-exercise device according to a preferred embodiment of the present invention will now be described with reference to FIGS. 1 to 6 of the accompanying drawings. More particularly, the portable multi-exercise device 10 includes a frame having a pair of parallel tracks 20, a pair of laterally spaced apart band attachment platforms 30, a pair of step platforms 50, and a rowing bar 60.

The portable multi-exercise device 10 includes a frame having a pair of tracks 20, each track having a first end 21 opposite a second end 22 and having an elongate and linear configuration that defines an imaginary longitudinal axis. The pair of tracks 20 are parallel to one another and have identical configurations. The frame may also include a pair of end bars 24, each end bar 24 extending between respective first ends 21 and second ends 22 of the pair of tracks 20, respectively. Preferably, the pair of end bars 24 are coplanar with and perpendicular to the pair of tracks 20. Also preferably, each end bar 24 is releasably coupled to respective ends of respective tracks 20 with T-shaped fasteners 25 with bolts or screws such that the pair of end bars 24 may be selectively attached or detached from the frame, which is advantageous when the portable multi-exercise device 10 is to be stored or moved to another location. In an embodiment, each end bar 24 may have a length that is longer than the distance between the parallel pair of tracks 20 (FIG. 1).

Figure 4:
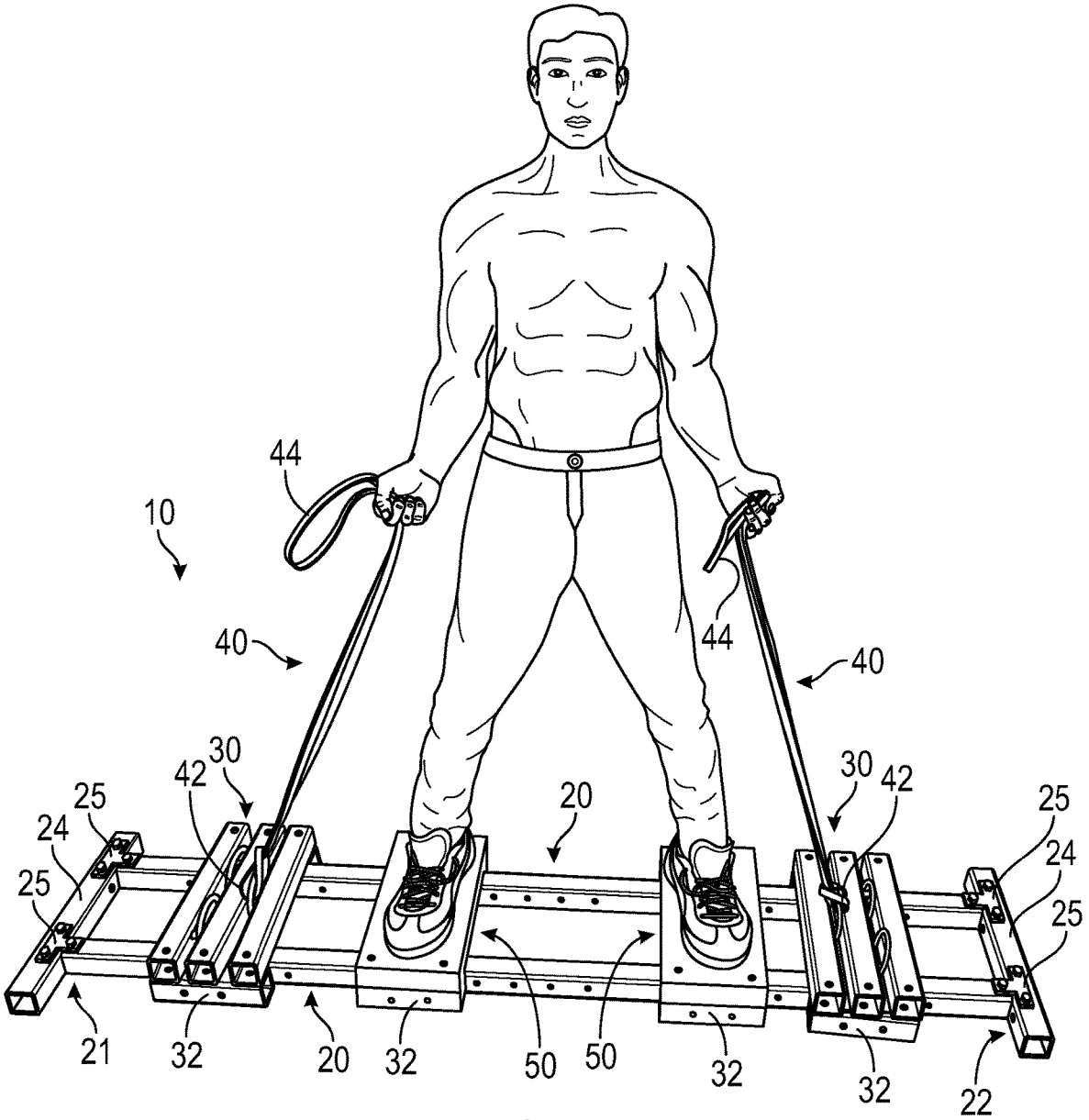
FIG. 4 is a front perspective view of the portable multi-exercise device according to another embodiment of the present invention, illustrating a pair of step platforms in a wide standing position and with a pair of resistance bands in a resilient and unstretched configuration.
Figure 5:
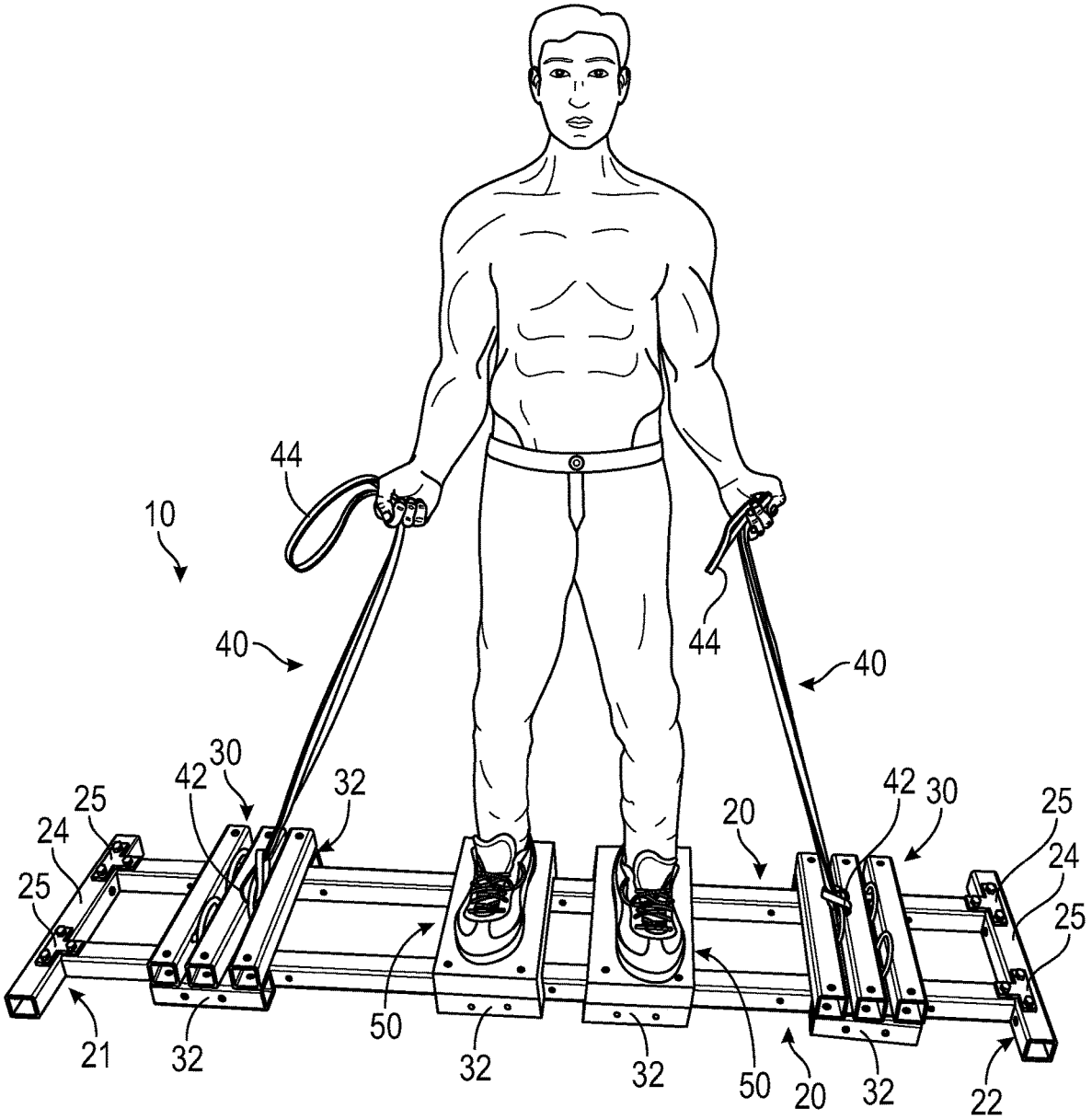
FIG. 5 is a front perspective view of the portable multi-exercise device as in FIG. 4, illustrated in a narrow standing position.
Figure 6:
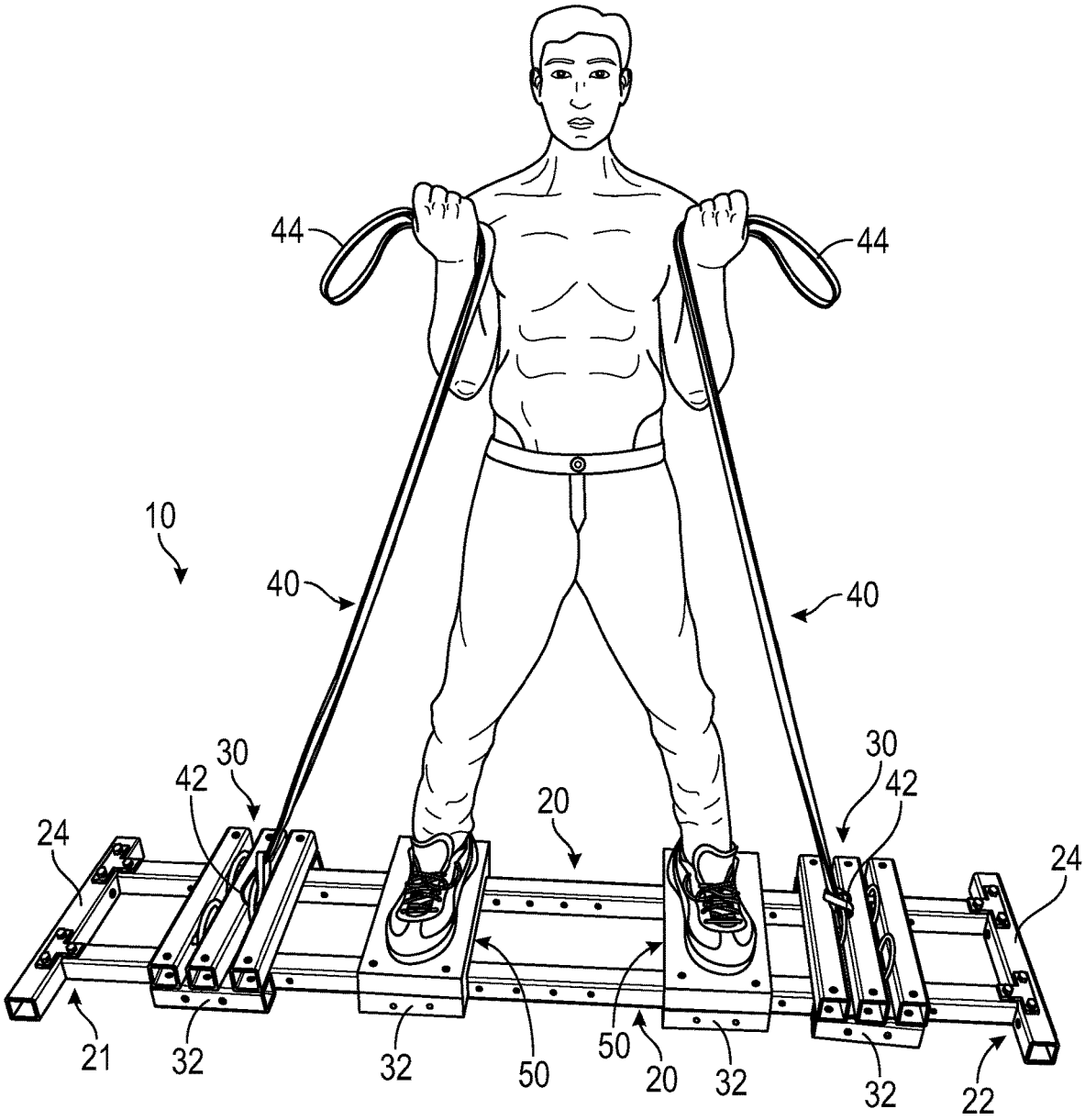
FIG. 6 is another front perspective view of the portable multi-exercise device as in FIG. 4, illustrated with the pair of resistance bands in a stretched exercise position.

The portable multi-exercise device 10 may include or be used with a pair of resistance bands 40, also referred to as elastic bands or resilient exercise bands. Each resistance band 40 may include a band fastener 42 at one end and may form a loop handle 44 at another end opposite the band fastener 42 as seen in FIGS. 4-6. In an embodiment, the band fastener 42 may be a carabiner, a hook, or other quick connect fastener. It is understood that resistance bands having various degrees of resistance may be available, i.e., that simulate associated levels of weight being lifted or pulled.

In a critical aspect, the portable multi-exercise device 10 includes a pair of band attachment platforms 30 each having an identical construction and each being releasably coupled to and extending across the pair of tracks 20. Each band attachment platform 30 has opposed ends that are operatively coupled to the pair of tracks 20, respectively, and are seen as being perpendicular to the imaginary longitudinal axis of each track 20. The pair of band attachment platforms 30 may each be displaced a first distance inwardly proximate the first ends and second ends of the pair of tracks 20, respectively. In other words, each band attachment platform 30 is positioned proximate opposite ends of the tracks 20. In an embodiment, the pair of band attachment platforms 30 may be coupled to the pair of tracks 20 using bolts or similar fasteners and, as a result, may be slidably and adjustably positioned along the pair of tracks 20, respectively. In an embodiment, the pair of band attachment platforms 30 and pair of tracks 20 may define complementary bolt holes for receiving complementary bolt fasteners. In another embodiment, the frame may include auxiliary mounting members 32 that may be coupled to respective tracks 20 and to respective ends of the band attachment platforms 30, as will be further described later.

In an embodiment, each band attachment platform 30 may include a first outer attachment structure 34 and a second attachment structure 36 inwardly spaced apart from the first attachment structure 34. Each attachment structure 34, 36 may be configured to selectively and releasably made with a band fastener 42 associated with each resistance band 40 described above. Accordingly, a different level of resistance and, potentially different muscle groups, may be affected by whether the first attachment structure 34 or second attachment structure 36 is coupled to a respective band fastener 42.

In the embodiment illustrated in the accompanying drawings, each band attachment platform 30 includes a set of three planks 31*a*, 31*b*, 31*c* mounted adjacent to and spaced apart from one another. The three planks 31*a*, 31*b*, 31*c* are parallel to one another and have opposed ends that are operatively coupled to the pair of tracks 20, respectively. Preferably, the three planks 31*a*, 31*b*, 31*c* define a slot 38, 39 between adjacent planks. Preferably, the first and second attachment structures are mounted and positioned in these slots 38, 39 so as to have a low profile. As best shown in FIG. 4, each attachment structure 34, 36 may include a hoop fastener (also referred to as a ring or ring fastener) mounted on a rod, dowel, bolt, or the like. It is understood that mounting a ring on an axial shaft extending between adjacent planks allows the ring to hang below adjacent planks when not needed but may easily be raised by a user's finger when attachment to associated band fastener 42 is desired. In an embodiment and as shown in the figures, the first attachment structure 34 may be implemented as a pair of laterally spaced apart hoop fasteners whereas the second attachment structure 36 may be implemented as a single hoop fastener. It is understood that this arrangement could be reversed or that any desired number of attachment structures may be positioned in either slot described above.

In another critical aspect of the present invention, the portable multi-exercise device 10 may include a pair of step platforms 50 coupled to the pair of tracks 20, respectively. Preferably, each step platform 50 is mounted intermediate or between the pair of band attachment platforms 30 and has a generally flat/horizontal surface extending between the pair of tracks 20, respectively. Accordingly, each step platform 50 includes a body portion having a length and width having a dimension that allows a user to stand atop the body portion. Each body portion has a length at least equal to the distance between the spaced apart tracks 20 and, in some embodiments, even longer as will be described later. As shown by comparing FIGS. 4 and 5, the pair of step platforms 50 may be coupled to the pair of tracks 20, respectively, at a (1) wide or spaced apart configuration wherein each step platform 50 is less displaced from a corresponding band attachment platform 30 or at a (2) narrow configuration wherein each step platform 50 is more displaced from a corresponding band attachment platform 30. In other words, the pair of step platforms 50 may be attached to the pair of tracks 20 wherein the user's feet are widely separated (FIG. 4) or at a position where the feet are close together (FIG. 5).

In another aspect, the portable multi-exercise device 10 may include a rowing bar 60 that also includes opposed ends, a linear configuration, and that defines a length that is at least equal to the space between the pair of tracks 20 or, in some embodiments, a little longer. In an embodiment, the rowing bar 60 may be positioned to extend across the pair of tracks 20 and may be releasably coupled thereto. When attached, the rowing bar 60 is, essentially, perpendicular to the pair of tracks 20. In addition, the rowing bar 60 may include third and fourth attachment structures that may be coupled to respective band fasteners 42 so that a user may be seated proximate an end bar 24, place his feet against the rowing bar 60 and do rowing exercises using the pair of resistance bands 40.

In some embodiments, the pair of band attachment platforms 30, pair of step platforms 50, and rowing bar 60 may be coupled directly to the pair of tracks 20, respectively. In other embodiments, however, the portable multi-exercise device 10 may include a plurality of mounting members 32 (introduced earlier) each being coupled to said pair of tracks 20 and to which the pair of band attachment platforms 30, pair of step platforms 50, and rowing bar 60 may be coupled. It is understood that the plurality of mounting members 32 may be positioned outwardly adjacent and coupled to outer side walls of the pair of tracks, respectively, each mounting member 32 being coplanar in parallel to the respective outer side wall (FIG. 1). In other words, each plank of the pair of band fastener platforms 30, the pair of step platforms 50, and the rowing bar 60 may have a length that is greater than the distance between the pair of tracks 20 such that the opposed ends of said structures may be aligned with and coupled to associated mounting members 32. This configuration is preferred in that it eliminates the need for bolts, bolt holes, or similar fasteners in a top surface of the pair of tracks 20.

In use, the portable, multi-exercise device 10 may be disassembled so as to be stored or transported in a bag or assembled in a home or hotel room and used for a multitude of both strength and cardio exercises. More particularly, the end bars 24 may be removed from the pair of tracks 20 by first removing the T-shaped fasteners 25, similarly, the pair of band attachment platforms 30, pair of step platforms 50, and rowing bar 60 may be disassembled by removing respective bolts. Then, the pair of tracks 20 may be stowed away or transported. The portable, multi-exercise device 10 may be assembled in a new location by reversing the disassembly described above.

It is understood that while certain forms of this invention have been illustrated and described, it is not limited thereto except insofar as such limitations are included in the following claims and allowable functional equivalents thereof.

The invention claimed is:

1. A portable multi-exercise device, comprising:

a frame having a pair of tracks that are parallel to one another and each track having an elongate and linear configuration and each track having a first end and a second end opposite said first end;

a pair of band attachment platforms coupled to said pair of tracks, respectively, each band attachment platform being displaced a first distance inwardly from said first and second ends of said pair of tracks, respectively;

each band attachment platform having a first outer attachment structure and a second attachment structure inwardly spaced apart from said first outer attachment structure;

wherein:

said each band attachment platform includes a set of three planks, each plank extending between and being releasably coupled to said pair of tracks, respectively;

said each plank is laterally spaced apart from a next adjacent plank with adjacent planks defining a slot therebetween, respectively; and said first outer attachment structure and said second attachment structure are axially coupled to said adjacent planks and positioned in said slots, respectively;

a pair of resistance bands each having a band fastener releasably and selectively coupled to said first outer attachment structure or said second attachment structure, respectively, and forming a loop handle opposite said band fastener, respectively; and a pair of step platforms coupled to said pair of tracks, respectively, each step platform being mounted intermediate said pair of band attachment platforms and being configured for supporting a foot of a user;

wherein one of said pair of step platforms being positioned along said pair of tracks a first selected distance apart from another of said pair of step platforms.

2. The portable multi-exercise device as in claim 1, wherein said one of said pair of step platforms is positioned along said pair of tracks a second selected distance apart from said another of said pair of step platforms, wherein said first selected distance is greater than said second selected distance.

3. The portable multi-exercise device as in claim 1, wherein said each band attachment platform is displaced a second distance inwardly from said first and second ends of said pair of tracks, respectively, wherein said second distance of displacement is different than said first distance of displacement.

4. The portable multi-exercise device as in claim 1, wherein said first outer attachment structure and said second attachment structure each includes a hoop fastener that is configured to releasably mate with said band fasteners of said pair of resistance bands, respectively.

5. The portable multi-exercise device as in claim 4, wherein:

said first outer attachment structure includes a single hoop fastener; and said second attachment structure includes a pair of laterally spaced apart hoop fasteners.

6. The portable multi-exercise device as in claim 1, further comprising a rowing bar extending between and being releasably coupled to said pair of tracks, respectively, said rowing bar being releasably coupled to said pair of tracks intermediate said pair of band attachment platforms; and wherein said rowing bar includes a third and fourth attachment structure configured to releasably mate with said band fasteners of said pair of resistance bands, respectively.

7. The portable multi-exercise device as in claim 1, wherein said frame includes a pair of end bars mounted to said first and second ends of said pair of tracks, respectively.

8. The portable multi-exercise device as in claim 7, wherein said pair of end bars are releasably coupled to said first and second ends of said pair of tracks, respectively, with T-shaped fasteners.

9. The portable multi-exercise device as in claim 1, further comprising a plurality of mounting members each being coplanar with, parallel to, and coupled to outer side walls of said pair of tracks, respectively;

wherein each plank includes opposed ends releasably coupled to said plurality of said mounting members, respectively.

* * * * *